United States Patent [19]

Anderson

[11] Patent Number: 4,458,622

[45] Date of Patent: Jul. 10, 1984

[54] BOAT HAVING A VARIABLE HULL CONFIGURATION

[76] Inventor: Ian L. Anderson, 7, Hauley Rd., Dartmouth, Devon, England

[21] Appl. No.: 354,062

[22] Filed: Mar. 2, 1982

Related U.S. Application Data

[63] Continuation-in-part of Ser. No. 194,366, Oct. 6, 1980, abandoned.

[30] Foreign Application Priority Data

Oct. 4, 1979 [GB] United Kingdom ..... 7934552
May 7, 1981 [GB] United Kingdom ..... 8113956

[51] Int. Cl.[3] ..... B63B 1/22

[52] U.S. Cl. ..... 114/284; 114/39; 114/56

[58] Field of Search ..... 114/283, 39, 284, 285, 114/286, 287, 56

[56] References Cited

U.S. PATENT DOCUMENTS

| | | | |
|---|---|---|---|
| 1,665,149 | 4/1928 | Van Wienen | 114/284 |
| 2,444,526 | 7/1948 | Pawley, Jr. | 114/39 |
| 3,236,202 | 2/1966 | Quady et al. | 114/39 |
| 3,288,236 | 11/1966 | Padial | 114/67 R |
| 3,413,948 | 12/1968 | Coll | 114/287 |
| 3,459,147 | 8/1969 | Ismay | 114/67 R |
| 3,498,248 | 3/1970 | Bibber | 114/286 |
| 3,678,874 | 7/1972 | Flink | 114/285 |
| 3,707,936 | 1/1923 | Harris | 114/285 |
| 3,938,458 | 2/1976 | Irgens | 114/285 |
| 4,004,536 | 1/1977 | Bernier | 114/144 R |
| 4,058,077 | 11/1977 | Johansson | 114/283 |

FOREIGN PATENT DOCUMENTS

| | | | |
|---|---|---|---|
| 2833095 | 2/1980 | Fed. Rep. of Germany | 114/283 |
| 43143 | 10/1970 | Finland . | |
| 1465680 | 1/1967 | France | 440/54 |
| 1574683 | 7/1969 | France . | |
| 7317684 | 7/1975 | Netherlands | 114/284 |

*Primary Examiner*—Trygve M. Blix
*Assistant Examiner*—Thomas J. Brahan
*Attorney, Agent, or Firm*—Fleit, Jacobson, Cohn & Price

[57] ABSTRACT

A boat having a variable hull configuration. The hull operates as a displacement hull designed for low resistance at sailing speeds and certain operating conditions. The hull includes an aft section having a pair of surfaces displaceable to a position and attitude such that at higher speeds, under power, the hull gives lift to the stern to facilitate a planing action. In the sailing or low speed mode, these surfaces can be stowed against the hull, if in the form of plates, or they may be solid bodies, such as wedges retracted into the hull by hand, mechanical, electrical or hydraulic operation.

4 Claims, 6 Drawing Figures

BOAT HAVING A VARIABLE HULL CONFIGURATION

CROSS-REFERENCE TO RELATED APPLICATION

This application is a continuation-in-part of U.S. patent application Ser. No. 194,366, filed Oct. 6, 1980, now abandoned.

BACKGROUND OF THE INVENTION

This invention relates to boats or vessels designed for operation under different conditions.

The criteria for an acceptable sailing boat and for an acceptable fast planing hull differ widely, so that the design of a "motor sailer" usually involves the use of a relatively small engine so that, when under power, the boat is used as a displacement vessel. Even so, there is a degree of compromise towards one use or the other. Where the requirement is for a power boat, or sailing boat that can also be used as a fast planing boat under power, there is a basic incompatibility of hull shape, and the present invention aims to remove this, or at least reduce it to negligible or acceptable proportions.

SUMMARY OF THE INVENTION

According to the invention, a vessel, such as a power boat or a sailing boat, comprises a displacement hull designed for low resistance at relatively low speeds, such as sailing speeds, and includes an aft section having a pair of surfaces displaceable to a position and attitude such that at higher speeds, such as speeds under power, the hull gives lift to the stern to facilitate a planing action.

Preferably, the hull shape is such that it includes an amidships area where the bottom of the hull is nearly flat so that at planing speeds it provides a principal planing supporting surface.

According to a feature of the invention, the surfaces are symmetrically arranged about the vessel center line and are hinged along a line which extends in approximately the same plane as the amidships area. The hinge line may thus conveniently extend from a point near the center line adjacent the stern, outwards and forwards to a point near the outside of a principal planing supporting surface. The displaceable surfaces may thus be approximately triangular in plan.

In the case of some hull shapes, it may be desirable for the displaceable surface to be sub-divided and separately operated in order to create the necessary area extending from the principal supporting surface. Moreover, the displaceable surfaces may, if desired, be operated so as to introduce a transverse step in the underwater sections of the hull.

The propulsion gear for use under power may be quite conventional, with a shaft log and a propeller bracket mounted below the hull. In a preferred arrangement, a transom drive unit is fitted to a transverse bulkhead located forward of the stern and is arranged, when not in use, to fold into a flooded compartment. The bottom of the compartment may be closed by one or more doors which follow the hull shape. The bulkhead conveniently may be part of a main bulkhead forward of the cockpit so that the engine is located in a housing accessible from the accommodation space.

The displaceable portions of the hull may be in the form of plates which follow the hull shape or are flexed to adapt to it. Alternatively, the displaceable portions may be solid bodies which fit into recesses in the hull so that, when extended, they have sides that reduce turbulence when planing. Such solid bodies are stronger and can be arranged to prevent the ingress of foreign bodies.

The use of a transom drive in the position outlined above has the advantages of accessibility and zero drag when sailing or operating at low speeds. Such design also places the weight of the engine and drive in the most beneficial position, both from the point of view of ballast and of minimising the area of the displaceable surfaces that is necessary to provide adequate lift for the stern.

BRIEF DESCRIPTION OF THE DRAWINGS

One form of the invention will now be described with reference to the accompanying drawings in which.

DESCRIPTION OF THE PREFERRED EMBODIMENTS

In the following description, an embodiment of the invention will be described in which the inventive planing surface will be used with a motor sailer. It should be readily apparent that the invention is usable with power boats that are not equipped with sails.

Figure 1:
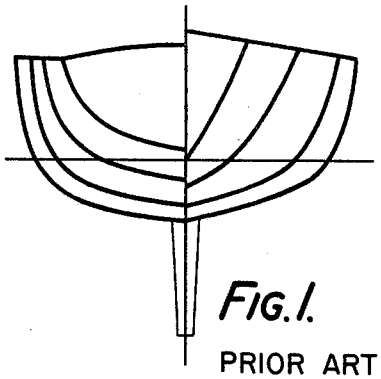
FIG. 1. PRIOR ART
FIG. 1 is a typical aft and fore section of a displacement type sailing hull.
Figure 2:
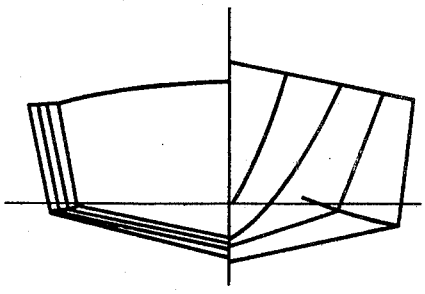
FIG. 2. PRIOR ART
FIG. 2 is a typical aft and fore section of a power planing hull.
Figure 3:
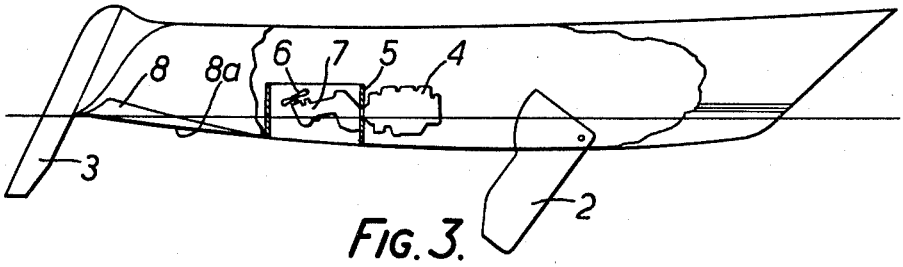
FIG. 3 is an elevational sketch of a boat to which the invention has been applied, when in the sailing mode.
Figure 4:
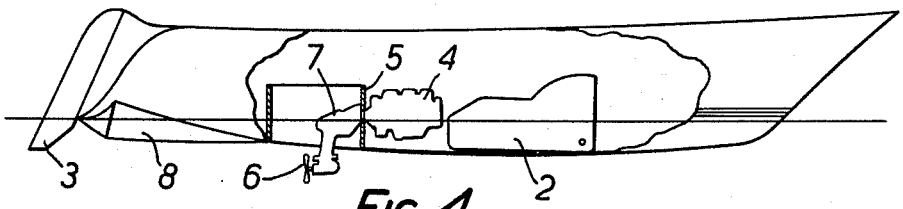
FIG. 4 is a view similar to FIG. 3 but in the power mode.

Referring first to FIGS. 1 and 2, there is shown typical after and forward hull sections of conventional shapes for respectively a displacement sailing hull and a power planing hull. It will be seen that these shapes are totally different. In FIGS. 3 and 4 however, which show one application of the invention, the hull 1 has a center plate 2 and a sailing rudder 3. The bottom sections are rounded and faired in the manner illustrated in FIG. 1. An engine 4 is located just ahead of the cockpit area and is mounted in conjunction with a bulkhead 5 through which it can drive a propeller 6 by means of a folding transom drive 7. A pair of approximately triangular hull sections 8 are completely retracted into the hull in FIG. 3 so as to present an uninterrupted outer surface, so the hull can be designed as an ideal sailing shape.

In FIG. 4, necessary changes have been made to convert the hull to a shape suitable for planing under power. The centre plate 2 has been raised into its casing, the rudder 3 has been retracted to have a smaller effective area, the transom drive leg 7 has been lowered to place the propeller 6 in its operative position, and the hull sections 8 have been moved downwards about hinge lines 8*a*. The effect of this is shown more clearly in FIGS. 5 and 6 which are perspective sketches showing the after underside of the hull in the conditions illustrated respectively in FIGS. 4 and 5. It will be seen that the hinge line 8*a* extends from a point adjacent the stern near the centre line, outwards and forwards to a point near the water line on the outside of the hull.

Although this appears as a curve in this view it can in fact be a straight line. The outside of the wedge section 8 can be arranged to coincide with a strake or chine so that the slight discontinuity introduced by having a separate section is kept to a minimum in its effect.

Figure 5:
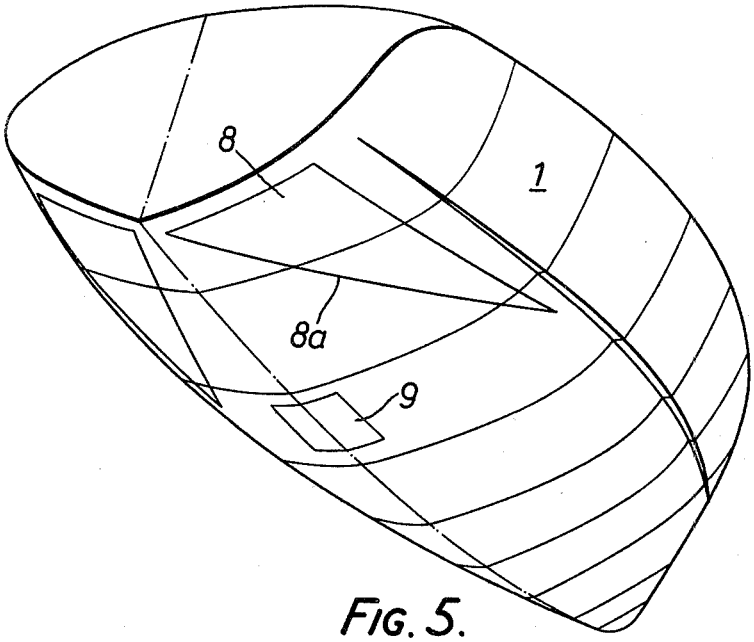
FIG. 5 is a perspective sketch of the after underside of the hull corresponding to the condition shown in FIG. 3.
Figure 6:
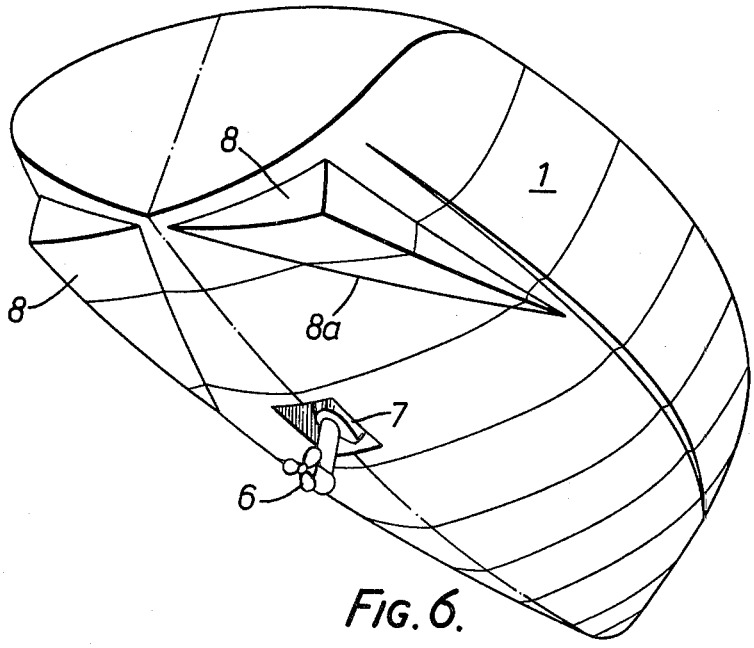
FIG. 6 is a perspective sketch similar to FIG. 5, but corresponding to the condition shown in FIG. 4.

It will also be seen from FIGS. 5 and 6 that when the leg of the transom drive unit 7 is retracted the continuity of the hull for sailing is maintained ny a pair of doors 9 conforming to the hull contour. These doors and the displaceable hull sections 8 are controlled from inside the boat and may be moved by means (not shown) which may consist of hand levers or mechanical, electrical or hydraulic actuators.

As an indication of the radical departure from existing craft offered by the invention, it has been determined by tank tests that a vessel of 36 feet L.O.A. can be powered, if sufficient attention is paid to weight saving in the structure and fittings, by a motor of 135 H.P., to give a planing speed of some 16 knots. Such a sailing vessel would ordinarily be fitted with an engine of not more than about 40 H.P., which would, without the improvements of the invention, give a speed under power of only 6 or 7 knots. Even if a 135 H.P. engine were fitted to such a conventional sailing vessel, the result would only be that it would trim up by the bow by about 13° and create much wash with a maximum speed of no more than 10 knots and a very high fuel consumption.

In summary, the present invention provides a hull configuration usable under varying operating conditions. The hull can have a smooth contour or be a multi-chine or double-chine hull.

According to the invention, such a boat comprises a hull designed to operate at low speeds as a "displacement" hull, for example a round bilge or multi-chine or double-chine hull, in which there are portions approximately amidships that are comparatively flat and comparatively horizontal aft from which the hull narrows and steepens and sweeps upwards to the waterline, the aft portion being characterised by a pair of surfaces displaceable out of the hull section about a line extending from a point towards the center line forwards to a point further outwards of the center line; the arrangement being such that the said amidships portion and the said surfaces combined are adequate to enable the boat to plane.

The boat may be a sailing boat or a motor craft the basic hull shape of which is a displacement hull such as a fishing boat. The application of the invention would thus permit the boat to be used as a planing boat, e.g., when lightly loaded and in reasonably fair weather, but could revert to normal operation in other conditions.

While the invention has been described herein in terms of preferred embodiments, numerous variations may be made in the arrangement illustrated in the drawings and herein described without departing from the invention as set forth in the appended claims.

What is claimed is:

1. A boat having a variable hull configuration comprising:

a round bilge hull with hull portions approximately amidship that are comparatively flat and comparatively horizontal, aft from which the hull narrows, steepens and sweeps to the water line; and a pair of displaceable surfaces convexly curved to conform to the hull shape located in the aft hull portion, the surfaces being moveable between extended and retracted positions about hinge lines extending from points adjacent the stern near the center line outwards and forwards to points near the water line, said hull having a first configuration in which the surfaces are in their retracted positions so that the hull forms a displacement hull, and a second configuration in which the surfaces are in their extended positions and cooperate with the comparatively flat and comparatively horizontal amidships portions to form planing surfaces for the hull.

2. A boat according to claim 1 characterised in that the displaceable surfaces are in the form of solid wedges having one surface which follows the basic hull shape.

3. A boat according to claim 2 characterised in that the hull is provided with cavities to accommodate the wedges when retracted.

4. A boat according to one of claims 1 to 3 characterised in that a flooded compartment is provided having an openable bottom formed in the hull surface ahead of the stern of the vessel for a drive unit which when not in use, can be drawn upwards into the flooded compartment, the forward wall of which is formed as a bulkhead through which a transom drive unit operates, the bulkhead being at least one of being forward of and forming the front wall of the cockpit.

* * * * *